United States Patent [19]

Watson et al.

[11] 3,946,852

[45] Mar. 30, 1976

[54] PRINTER

[75] Inventors: Alan J. Watson, Montville; Heinz R. Guenther, Cedar Knolls, both of N.J.

[73] Assignee: Texas Instruments Incorporated, Dallas, Tex.

[22] Filed: Mar. 11, 1974

[21] Appl. No.: 449,883

[52] U.S. Cl. ..... 197/53; 197/18

[51] Int. Cl.[2] ..... B41J 1/32

[58] Field of Search ..... 197/48–55, 197/18, 6.7

[56] References Cited

UNITED STATES PATENTS

| | | | |
|---|---|---|---|
| 2,547,046 | 4/1951 | Salmon | 197/53 |
| 3,280,954 | 10/1966 | Bremer et al. | 197/6.7 |
| 3,356,199 | 12/1967 | Robinson | 197/53 X |
| 3,442,365 | 5/1969 | Ragland et al. | 197/53 |
| 3,605,977 | 9/1971 | Janz et al. | 197/55 X |
| 3,651,916 | 3/1972 | Becchi | 197/54 |
| 3,760,925 | 9/1973 | Bossi | 197/53 |

*Primary Examiner*—Edgar S. Burr
*Assistant Examiner*—Edward M. Coven
*Attorney, Agent, or Firm*—Harold Levine; Edward J. Connors, Jr.; John G. Graham

[57] ABSTRACT

A printer includes a print wheel having an outer circular row of typefaces comprising digits and punctuation signs and an inner circular row of typefaces comprising symbols, and hammer apparatus for actuating the typefaces of the print wheel to effect printing. The type wheel and the hammer apparatus are mounted on a carriage which travels along a path defining a left-hand group of printing positions and a right-hand group of printing positions. A cam extending along the path of the carriage functions to pivot the type wheel between a position wherein the outer row of typefaces is aligned with the hammer apparatus when the carriage is aligned with the left-hand group of printing positions and a position wherein the inner row of typefaces is aligned with the hammer apparatus when the carriage is aligned with the right-hand group of printing positions. A drive motor is mounted on the carriage and functions both to continuously rotate the print wheel and to continuously propel the carriage back and forth along the path. The print wheel includes a plurality of radially extending arms each mounting a type font comprising one typeface of the outer row and one typeface of the inner row, a shield plate engaging the arms and comprising a plurality of apertures each receiving one of the type fonts, and a damper disk which cooperates with the shield plate to dampen vibrations of the arms following actuation of the hammer apparatus.

4 Claims, 9 Drawing Figures

PRINTER

BACKGROUND AND SUMMARY OF THE INVENTION

This invention relates to a printer, and more particularly to a low cost printer that is especially adapted for use in conjunction with electronic calculators, and the like.

As is well known, there is currently considerable interest in the field of low cost electronic calculators. In the case of the small pocket type calculators, the output typically comprises a visual readout. However, in the case of larger calculators, and particularly in the case of calculators intended for office use, it is considered preferable to provide a printed output, either alone or in combination with a visual readout. Thus, a need has arisen for a printer that is economical to manufacture, reliable in operation, and capable of long term, substantially maintenance free service.

The present invention comprises a printer that fulfills the foregoing requirements and is therefore particularly adapted for use in conjunction with low cost electronic calculators and similar applications. The printer is adapted for fabrication from a small number of relatively simple parts and thus is economical to manufacture. At the same time, the printer is adapted for long term, substantially maintenance free service. These combined characteristics of the printer of the present invention render its use highly advantageous over printers of the prior art.

In accordance with more specific aspects of the invention, a printer includes a continuously rotating print wheel having two rows of typefaces. Hammer structure is provided for actuating the typefaces to effect printing. The print wheel and the hammer structure are mounted on a carriage which functions to continuously move the print wheel and the hammer along a plurality of printing positions.

The printing positions are arranged in two groups with the left-hand group including nine printing positions and the right-hand group including two positions, the latter being separated from the left-hand group by a space. A cam includes a first portion corresponding to the first group of printing positions, a camming surface corresponding to the space separating the two groups of printing positions, and a second portion corresponding to the second group of printing positions. A cam follower engages the cam and functions to pivot the print wheel on the carriage mechanism between a first position wherein the first row of typefaces is aligned with the hammer mechanism, and a second position wherein the second row of typefaces is aligned with the hammer mechanism. The first row of typefaces includes the digits 0 through 9, inclusive, the comma (,) and the decimal (.) so that only numerical and punctuation entries are printed in the left-hand group of printing positions. The second row of typefaces includes all of the symbols, so that only symbols are printed in the right-hand group of printing positions.

The carriage mechanism includes a drive motor which rotates the drive pinion. A print wheel drive gear meshes with the drive pinion and is operatively connected to the print wheel to effect rotation thereof under the action of the drive motor. A reduction gear also meshes with the drive pinion and a pinion mounted on the reduction gear meshes with a rack to effect movement of the carriage mechanism under the action of the drive motor.

The print wheel comprises a plurality of radially extending arms each having a type font mounted thereon which includes a typeface in the first row and a typeface in the second row. The arms are nominally 30° apart but are offset from this positioning so as to properly align the typefaces with the printing positions. Structure is provided for damping the movement of the arms following actuation thereof by the hammer structure.

DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
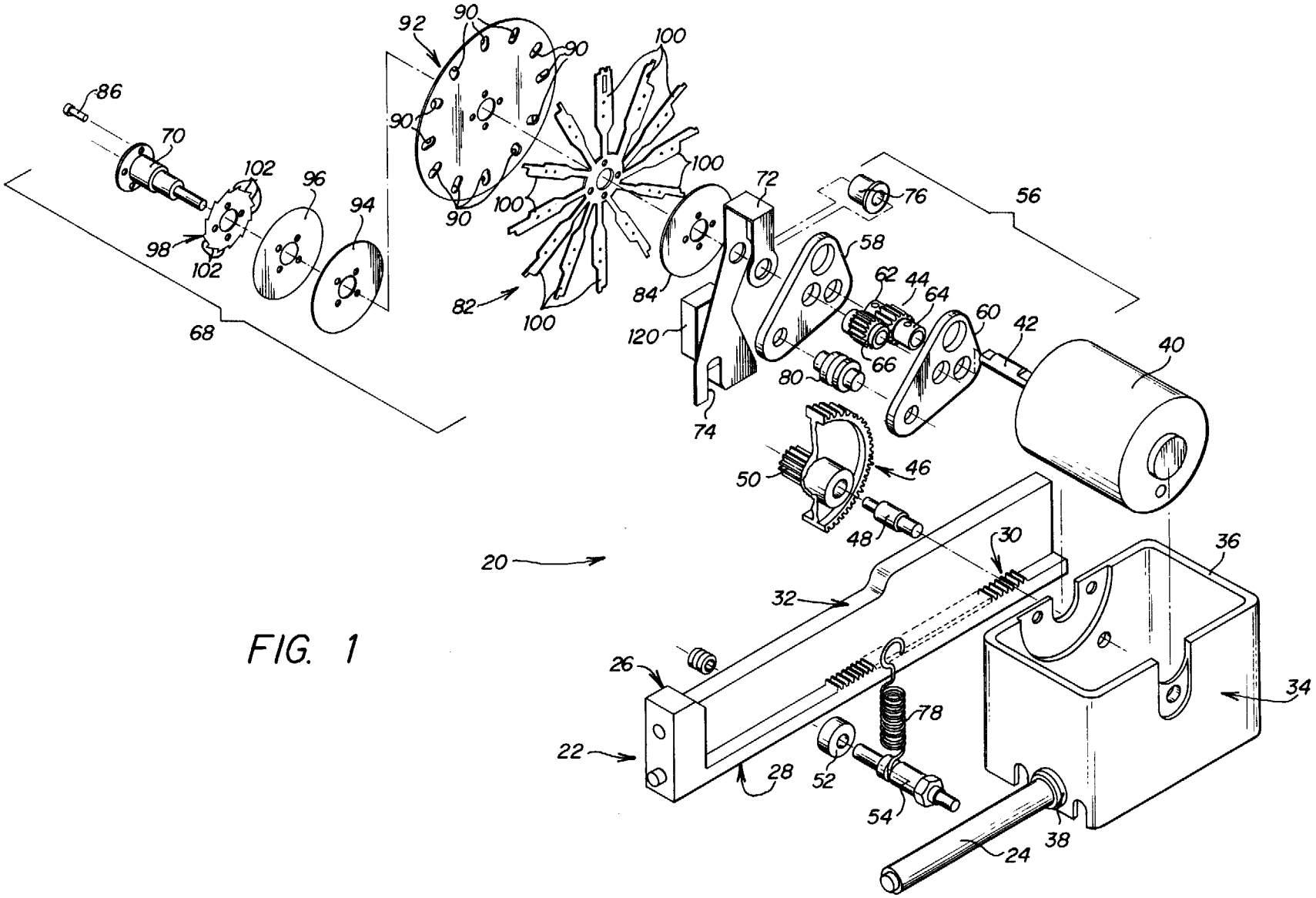
FIG. 1 is an exploded view of a printer incorporating the invention.

Referring now to the Drawings, and particularly to FIG. 1 thereof, there is shown a printer 20 incorporating the invention. The printer 20 includes a frame 22 comprising a guide rod 24 defining a path of carriage movement and a combined guide, rack, and cam member 26 extending parallel to the guide rod 24. The member 26 includes a guide surface 28 formed on the underside thereof, a rack 30 extending parallel to the guide rod 24, and a cam 32 extending above the rack 30.

A carriage 34 includes a housing 36 supported for sliding movement on the guide rod 24 by means of bearings 38 (only one of which is shown). A drive motor 40 is secured in the housing 36 by suitable fasteners and has an output shaft 42. A drive pinion 44 is mounted on the output shaft 42 for rotation under the action of the drive motor 40.

A reduction gear 46 is mounted in mesh with the drive pinion 44. The gear 46 is rotatably supported on the housing 36 by means of a shaft 48 and has a pinion 50 affixed thereto. The pinion 50 is mounted in mesh with the rack 30, whereby the drive motor 40 operates through the drive pinion 44, the reduction gear 46, the pinion 50, and the rack 30 to continuously propel the carriage 34 back and forth along the guide rod 24.

In the practice of the invention the drive motor 40 is utilized both to propel the carriage 34 in one direction to effect printing and to propel the carriage in the opposite direction to effect carriage return. The printer is provided with conventional switching apparatus which automatically reverses the direction of current flow to the motor 40 when the carriage 34 reaches the opposite ends of its travel. Moreover, the magnitude of voltage flow to the motor 40 is increased during carriage return so as to move the carriage back to the starting position relatively rapidly.

It will be understood that since the reduction gear 46 is rotatably supported on the housing 36, and since the pinion 50 engages the rack 30, the housing 36 is prevented from pivoting downwardly toward the member 26. Pivoting of the housing 36 in the opposite direction is prevented by a roller 52 which engages the guide surface 28 on the underside of the member 26. The roller 52 is pivotally supported on the housing 36 by a shaft 54. Thus, by means of the pinion 50 of the reduction gear 46 and the roller 52, the carriage 34 is constrained to movement back and forth along the guide rod 24.

The printer 20 further includes a print wheel support assembly 56. The assembly 56 comprises a pair of spaced, parallel plates 58 and 60 which are pivotally supported on a pair of collars 62 and 64 extending from the opposite ends of the drive pinion 44, respectively. Since the drive pinion 44 is mounted on the output shaft 42 of the drive motor 40, it will be understood that the plates 58 and 60 are supported for pivotal movement about the axis of the shaft 42. A print wheel drive gear 66 is rotatably supported on the plates 58 and 60 and is mounted in mesh with the pinion 44. A print wheel assembly 68 includes a drive shaft 70 which receives the gear 66. Thus, the drive motor 40 functions through the drive pinion and the gear 66 to continuously rotate the component parts of the print wheel assembly 68.

The print wheel support assembly 56 includes a support member 72 which receives the drive shaft 70 of the print wheel assembly 68. A slot 74 is formed in the lower end of the support member 72 and receives the roller support shaft 54 to control the pivotal positioning of the support member 72. A bearing-type cam follower 76 is received in the support member 72 and is rotatably supported on the drive shaft 70. The outer periphery of the cam follower 76 engages the cam 32 of the member 26 to control the pivotal positioning of the plates 58 and 60, the gear 66, the print wheel assembly 68, and the support member 72 relative to the remaining components of the carriage 34. The cam follower 76 is maintained in engagement with the cam 32 by a spring 78 connected between the roller support shaft 54 and a shaft 80 mounted between the plates 58 and 60 of the roller support assembly 56.

The construction of the print wheel assembly 68 is illustrated in FIGS. 1, 6, 7 and 8. The drive shaft 70 includes a hub 71 which supports a print wheel 82. The print wheel 82 is retained by means of a back disk 84 and a plurality of rivets 86. The print wheel 82 supports a plurality of type fonts 88 each extending through an aperture 90 formed in a shield plate 92. It will be noted that the shield 92 is mounted in engagement with the print wheel 82.

The print wheel assembly 68 further includes a damper disk 94 positioned on the opposite side of the shield plate 92 from the print wheel 82. A control disk 96 is mounted between the damper disk 94 and a print wheel disk 98. As is best shown in FIG. 1, the print wheel 82 comprises a plurality of arms 100. The print wheel disk 98 comprises a corresponding number of edges 102 each serving to establish the point of flexure of one of the arms 100 of the print wheel 82.

Figure 6:
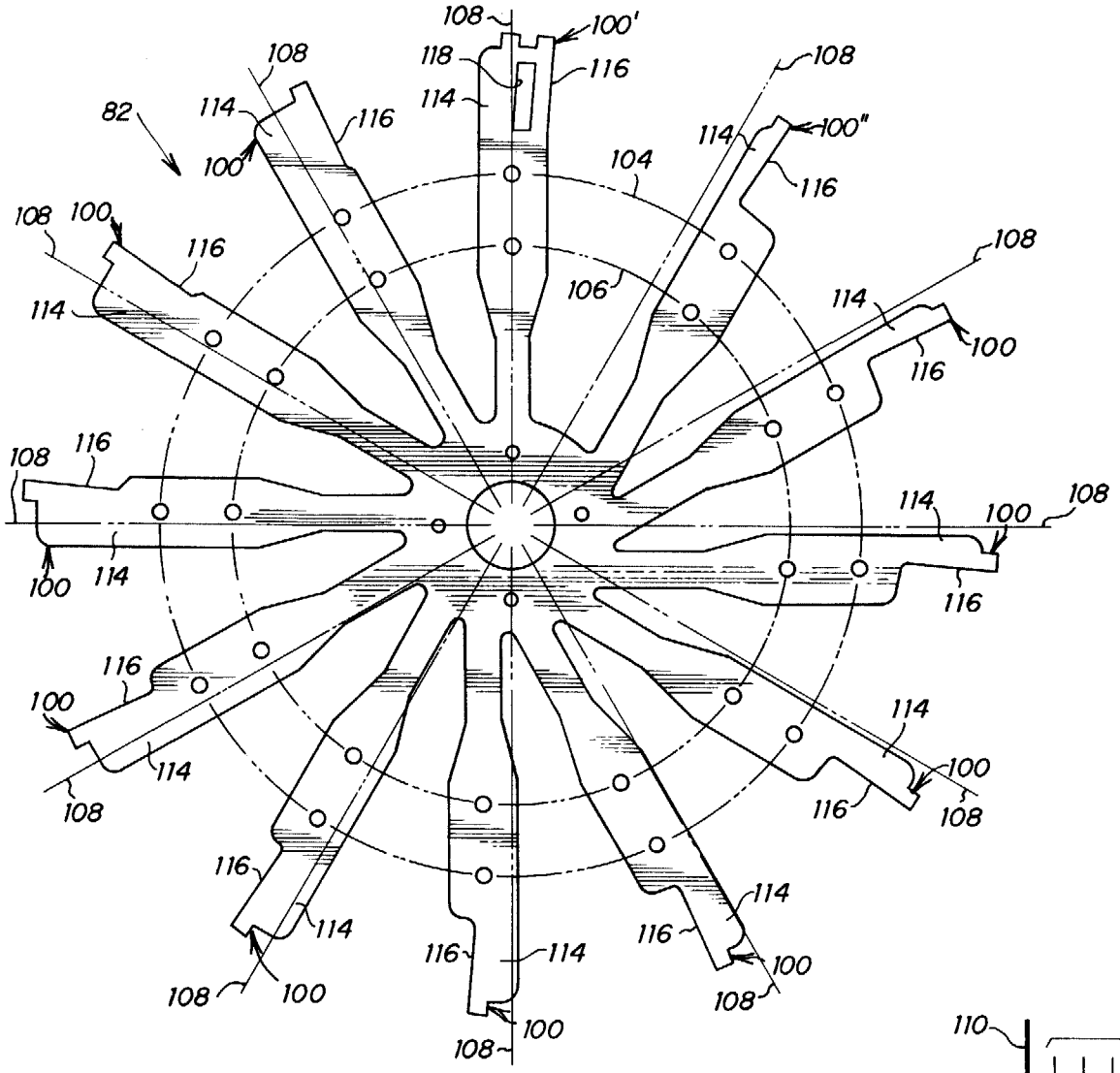
FIG. 6 is an illustration of the print wheel of the printer.

The construction of the print wheel 82 of the print wheel assembly 68 is shown in greater detail in FIG. 6. The print wheel 82 comprises 12 arms 100 each having one of the type fonts 88 mounted thereon. Each of the type fonts 88 in turn comprises two typefaces. Thus, the print wheel 82 may be considered as comprising two spaced, concentric, circular rows of typefaces 104 and 106. In the particular embodiment of the invention illustrated in the Drawings, the row of typefaces 104 comprises the 10 digits 0 through 9, inclusive, plus the punctuation signs decimal (.) and comma (,). On the other hand, the row of typefaces 106 is comprised entirely of symbols. These include the common addition, subtraction, multiplication and division symbols; the equals sign; total and subtotal symbols; the percent symbol; the "number" symbol which is commonly used for non-add, a diamond symbol; the "M" symbol; and an error symbol.

As is indicated by the lines 108 in FIG. 6, the 12 arms 100 comprising the print wheel 82 are nominally spaced at 30° intervals. However, the arms 100 are actually positioned with respect to the lines 108 in accordance with a predetermined pattern in which the arm 100' is aligned with the corresponding line 108 and in which the offset of the arms 100 with respect to the corresponding lines 108 is progressively increased to a maximum in the case of the arm 100''. In the operation of the printer 20, the print wheel assembly 68 is continuously rotated and the carriage 34 is continuously moved relative to the guide rod 24 under the action of the drive motor. Thus, referring to FIG. 7, and assuming that the bold lines 110 and 110' represent adjacent printing positions, the lines 112 illustrate the actual positioning of the axis of rotation of the print wheel 82 at the time when each of the arms 100 is in the printing position. The arms 100 are therefore offset from the nominal positions as indicated by the lines 108 in order to properly position the type fonts 88 to effect printing when their respective arms 100 are brought into the printing positions by the rotation of the print wheel.

It will be noted that the type fonts 88 are supported in the midportions of the arms of the print wheel 82. The distal ends of the arms 100 comprise identification portions 114 each having a leading edge 116 and each varying in width. In addition, the arm 100' at the home position is provided with an aperture 118 in the identification portion 114 thereof.

Referring again to FIG. 1, a print wheel position identification assembly 120 is mounted on the support member 72 of the print wheel support assembly 56. The assembly 120 includes a light source, for example a light emitting diode, which directs light towards the rotating arms 100 of the print wheel 82. The assembly 120 further includes a photosensitive member which receives light generated by the source and reflected from the identification portions 114 of the rotating arms 100. By this means the assembly 120 functions in conjunction with associated electronic circuitry to precisely identify the particular typeface which is in the printing position.

Figure 4:
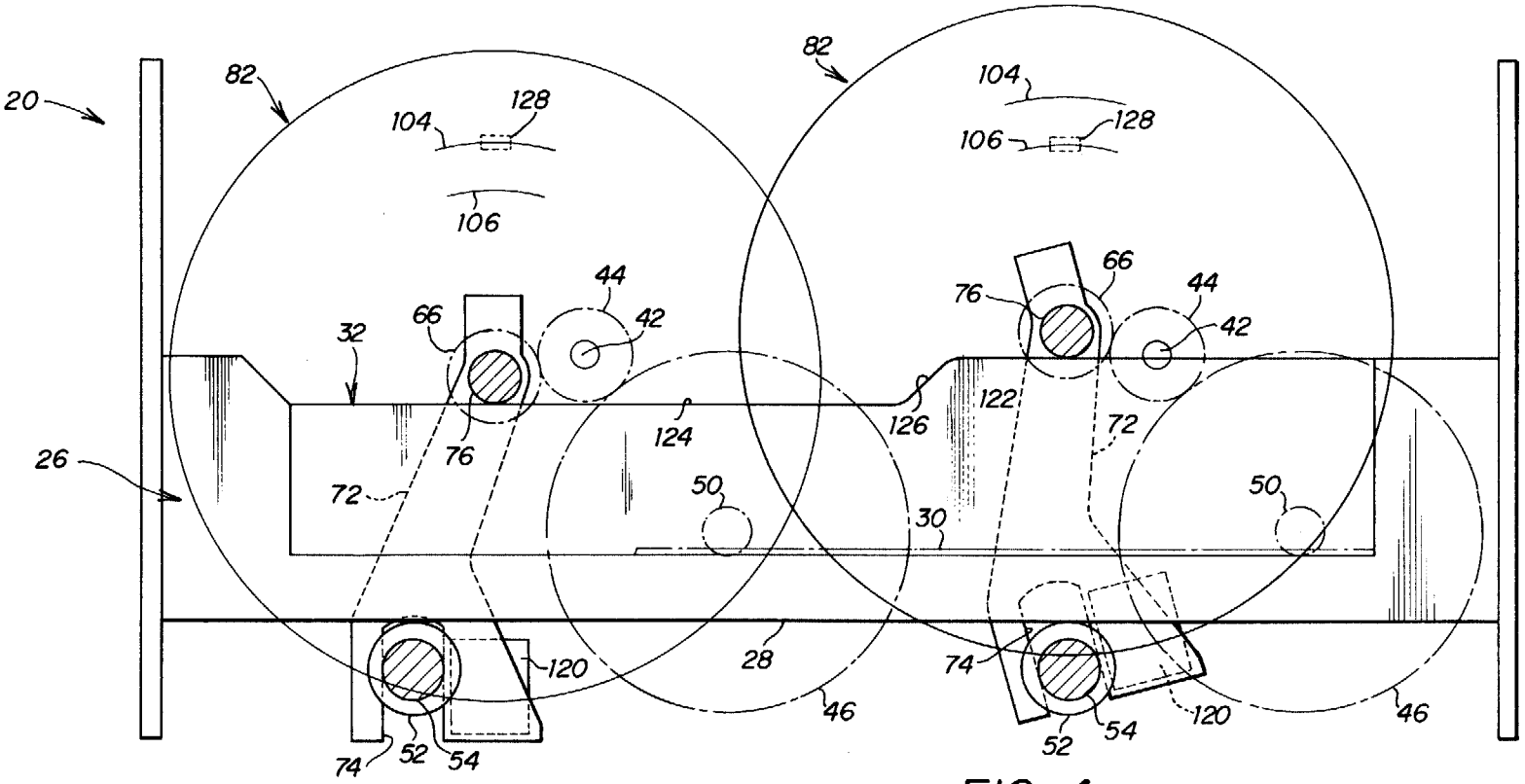
FIG. 4 is an illustration useful in understanding the operation of the printer.

A more complete understanding of the operation of the printer 20 may be had by reference to FIG. 4. The cam 32 of the member 26 includes a first portion 122 extending parallel to the path of movement of the carriage 34, a second portion 124 extending parallel to the path of movement of the carriage 34 and at a different elevation than the first portion 122, and a camming portion 126 interconnecting the first and second portions 122 and 124. When the cam follower 76 engages the first portion 122 of the cam 32 the component parts of the print wheel support assembly 56 and particularly the print wheel 82 are positioned as shown in the right-hand portion of FIG. 4. This positions the typefaces comprising the circular row 106, i.e., the symbols, in alignment with the printing position 128. On the other hand, when the cam follower 76 engages the second portion 124 of the cam 32, the typefaces comprising the circular row 104, i.e., the 10 digits 0 through 9 and the punctuation signs decimal (.) and comma (,) are positioned in alignment with the printing position 128. It will thus be understood that the printer 20 functions to automatically shift between the row of typefaces comprising the symbols and the row of typefaces comprising the digits and the punctuation signs in accordance with the positioning of the carriage 34 along its path of travel.

The printer 20 utilizes a printing format corresponding to the printing format typically employed in conjunction with electronic calculators and similar devices. Thus, the right-hand portion of the printing format corresponding to engagement of the cam follower 76 with the first portion 122 of the cam 32 is the portion of the format in which only symbols are printed. The left-hand portion of the printing format corresponding to engagement of the cam follower 76 with the second portion 124 of the cam 32 is the portion in which only digits and punctuation signs are printed. The intermediate portion of the format corresponding to engagement of the cam follower 76 with the camming portion 126 of the cam 32 represents a blank space between the right-hand symbols portion and the left-hand digits portion. Operation of the printer 20 to effect printing is inhibited when the carriage 34 is in this portion of its travel.

Figure 3:
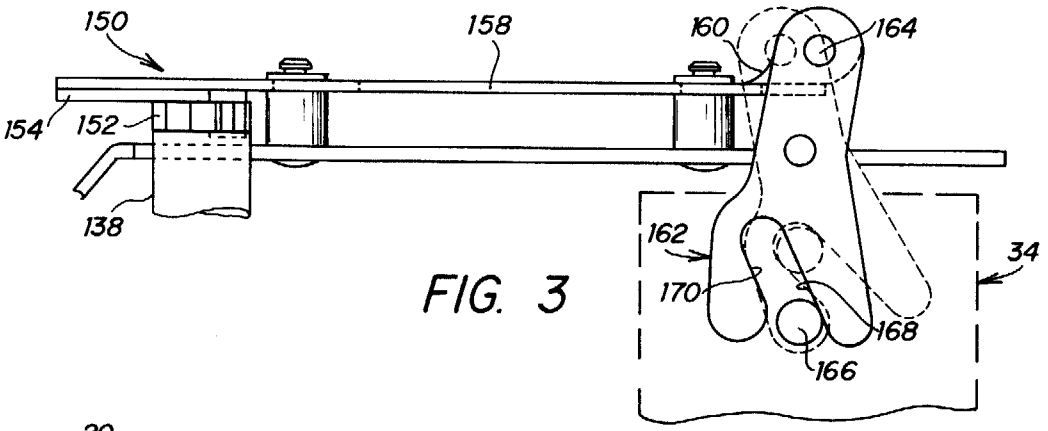
FIG. 3 is an illustration of the line feed mechanism of the printer.
Figure 2:
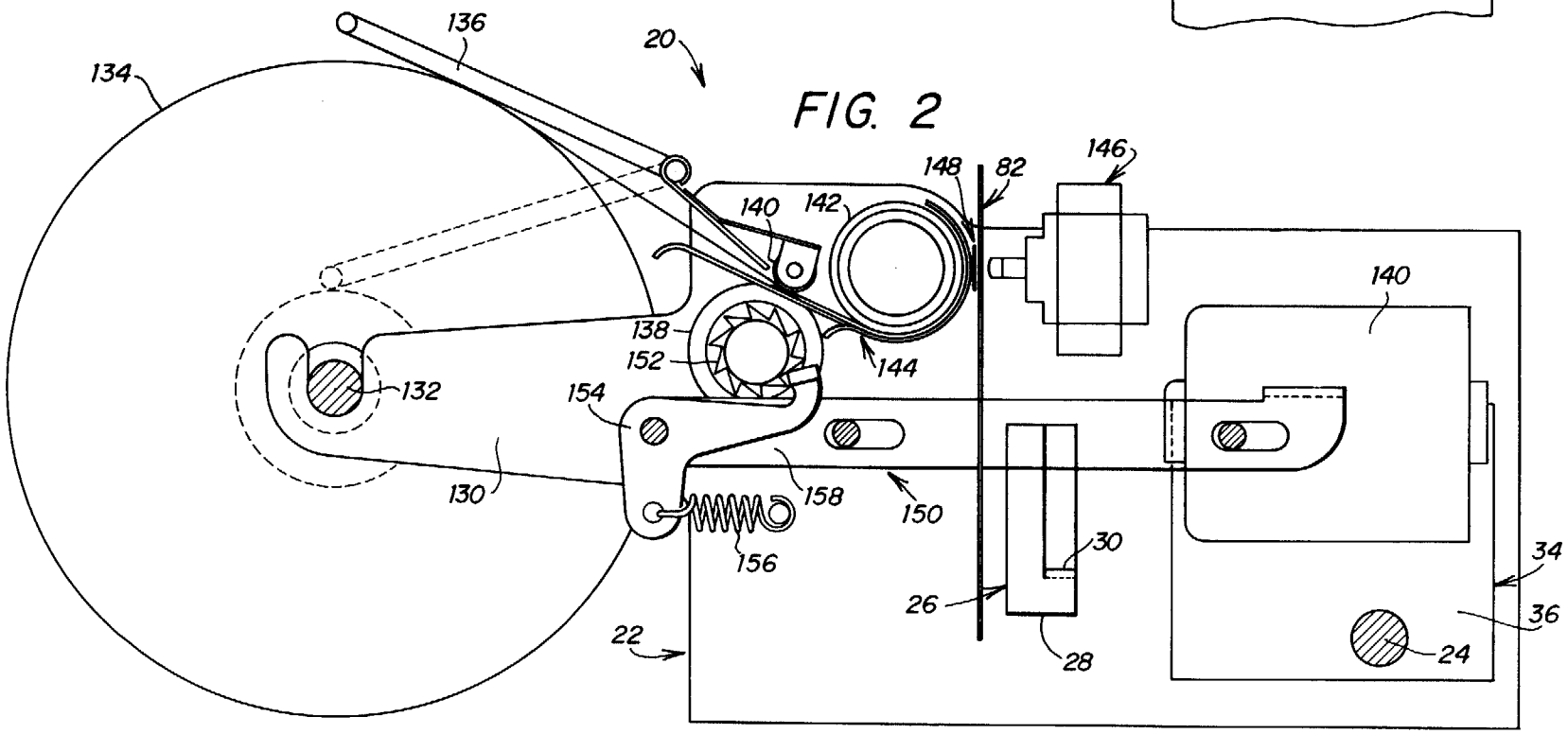
FIG. 2 is a side view of the printer in which certain parts are illustrated diagrammatically.

Referring now to FIGS. 2 and 3, the frame 22 of the printer 20 further includes a rearwardly extending arm 130 which supports a shaft 132. The shaft 132 in turn supports a roll of printing paper 134 which comprises the paper tape typically employed in electronic calculators and similar devices. A spring-loaded arm 136 engages the roll of printing paper 134 to prevent undesirable unwinding of the printing paper.

The leading end of the roll of printing paper 134 extends between a pair of pinch rollers 138 and 140 and then around a platen 142. A guide assembly 144 is provided to facilitate the initial positioning of the printing paper in the printer 20. Printing is effected by means of the print wheel 82, a hammer assembly 146, and a ribbon 148 positioned between the print wheel 82 and the printing paper on the platen 142. In the operation of the printer 20 the ribbon 148 is perodically advanced by means of a conventional ribbon advance mechanism.

The feeding of the printing paper 34 in the printer 20 is effected by means of a line feed mechanism 150. A ratchet wheel 152 is secured to one end of the pinch roller 138. A pawl 154 is maintained in engagement with the ratchet wheel 152 by a spring 156. The pawl 154 is pivotally supported at one end of an oscillating arm 158.

Referring to FIG. 3, the opposite end of the arm 158 has a bent-over portion 160 which is connected to a pivotally supported arm 162 by means of a pin 164. A pin 166 is mounted on the carriage 34 for movement therewith. When the carriage 34 reaches one end of its travel, the pin 166 engages a camming surface 168 on the arm 162, whereupon the arm 162 is pivoted from the position shown in full lines in FIG. 3 to the position shown in dashed lines therein. During return movement of the carriage 34 the pin 166 engages the camming surface 170 on the arm 162, whereupon the arm 162 is returned to the position shown in full lines in FIG. 3. This completes a full oscillation of the arm 158 which in turn causes the pawl 154 and the ratchet 152 to effect the advance of the printing paper 134 relative to the platen 142.

Figure 5:
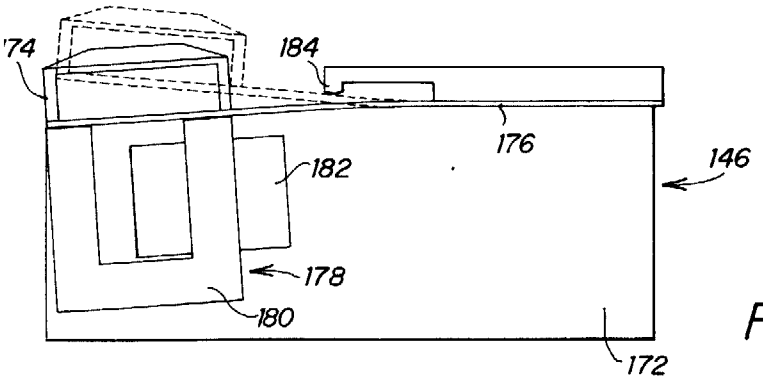
FIG. 5 is an illustration of the hammer mechanism of the printer.
Figure 8:
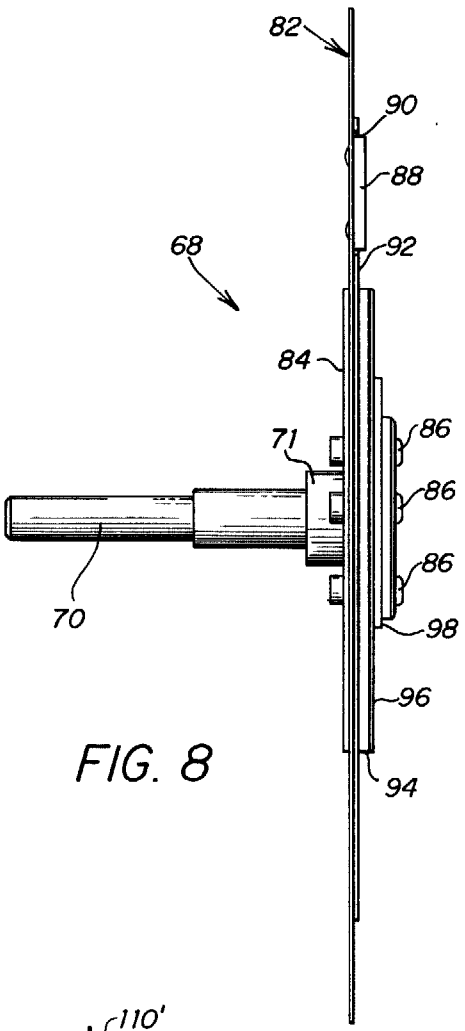
FIG. 8 is a side view of the print wheel assembly of the printer.

The construction and operation of the hammer assembly 146 of the printer 20 will be better understood by reference to FIG. 5. A subframe 172 is supported on the housing 36 of the printer 34 for movement therewith. A hammer 174 is supported on the subframe 172 by a leaf spring 176. The hammer 174 is normally retained in the position shown in full lines in FIG. 5 by an electromagnet 178 comprising a yoke 180 and a coil 182 mounted thereon. Upon de-energization of the coil 182 the hammer 174 moves forwardly under the action of the leaf spring 176. The movement of the hammer is accelerated by engagement of the leaf spring 176 with a pivot point 184 comprising part of the subframe 172. This causes the hammer 174 to move rapidly into engagement with the selected typeface of the print wheel 82, whereupon the typeface drives the ribbon 148 into engagement with the printing paper 134 to effect printing of the selected character. Following a printing operation the coil is energized whereby the electromagnet 178 captures the hammer on its return stroke.

The hammer assembly 146 comprises a highly advantageous feature of the printer 20. It will be understood that because the printer 20 is an "on-the-fly" printer, the hammer must operate very rapidly in order to effect printing without smearing of the printed characters. An important aspect of the hammer assembly 146 in this regard is the use of the pivot point 184 which serves to greatly accelerate the movement of the hammer 174 into and out of engagement with the type fonts 88 on the front wheel 82.

Other important advantages in the operation of the printer 20 are realized by means of the construction of the print wheel assembly 68. Upon actuation of the hammer assembly 146 to effect printing, the selected arm 100 of the print wheel 82 is caused to slide on the engaging surface of the shield plate 92. Further damping is provided by the print wheel damper disk 94. The combined effect of these component parts is to rapidly and positively return the selected arm 100 to the dormant position without detrimental subsequent vibration of the arm 100 and the font 88 carried thereby. This in turn permits the printer 20 to accomplish the printing of highly legible characters and to eliminate any noticeable smearing of the printed characters even though the print wheel 82 rotates continuously during the operation of the printer 20.

Figure 9:
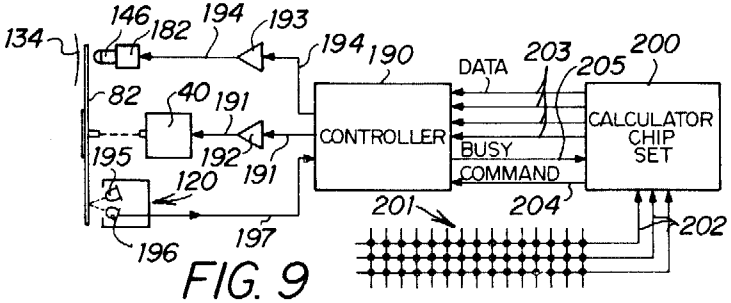
FIG. 9 is a simplified diagram of a calculator system employing the printer of the invention.
Figure 7:
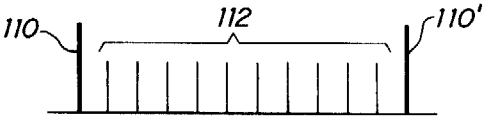
FIG. 7 is an illustration useful in understanding the positioning of the arms of the print wheel.

A simplified electrical diagram of the printer 20 as described above as it may be used in a calculator system is shown in FIG. 9. The electrical parts of the printer 20 include the drive motor 40, the coil 182 for the hammer 146, and the print wheel position identification assembly 120. These devices are all connected to a controller 190 which generates appropriate electrical signals to operate the printer. The drive motor 40 receives drive current from the controller 190 via lines 191, and a suitable power amplifier 193 is connected in line 194 between the controller 190 and the coil 182 for the hammer, since several amps at perhaps 50 volts may be needed for operating the hammer rapidly. The assembly 120 includes a light emitting diode 195 which may be continuously powered, and a photosensor 196 which is connected to the controller 190 by a line 197 to provide signals as seen in FIG. 7 representing the radial position of the print wheel 82. The controller 190 receives data and print commands from a calculator chip or chip set 200 which may be of the type disclosed in co-pending applications Ser. No. 255,856, filed May 22, 1972, and Ser. No. 397,060, filed Sept. 13, 1973, assigned to TEXAS INSTRUMENTS INCORPORATED. The chip set 200 receives numerical data and functional commands from a keyboard 201 on input lines 202, performs various manipulation on the data in accordance with the commands and its internal programming, and sends out data to be printed on lines 203. The data output is usually in binary-coded-decimal format, and is bit-parallel and serial digit. The calculator chip set also produces print commands which are connected to the controller 190 via line 204. Actually, the commands and related timing signals may require several such lines. The controller 190 sends back a "busy" signal on line 205 to stop the calculator while the printer is operating; the calculator sends a data word of perhaps 16 digits via lines 203 in a time period of a few microseconds, but the printer 20 needs perhaps a half-second or so to execute a print command for one line. Thus, the busy signal indicates that the printer is operating and no further data can be accepted. The controller 190 functions to activate the drive motor 40 via line 191 when a print command is received, then detect the position of the print wheel 82 via signals on line 197. Further, the BCD data which comes in on lines 203 is stored in the controller and converted from BCD to a representation of radial position of the print wheel for each digit to be printed so that a signal is applied to the line 194 at the proper time to actuate the hammer 146 to print the desired character for each column. The controller 190 may be a general purpose MOS/LSI processor chip which is programmed to execute these functions.

From the foregoing it will be understood that the present invention comprises a printer incorporating numerous advantages over the prior art. Considered structurally, the printer of the present invention is characterized by a relatively small number of easily fabricated parts, and is therefore adapted for extremely low cost manufacture. These same characteristics also result in a printer which is adapted for long term, substantially maintenance free service. Considered functionally, the printer of the present invention operates automatically to print characters and punctuation signs in the left-hand portion of the print format and to automatically print symbols in the right-hand portion of the printing format while completely eliminating the usual shifting mechanism and control apparatus therefore. The printer also dispenses with the carriage return mechanism which is characteristic of many prior art printers.

Although particular embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. A printer comprising:

a type wheel having two radially spaced, concentric, circular rows of typefaces;

hammer means for selectively actuating the typefaces of the print wheel to effect printing;

carriage means for moving the print wheel and the hammer means along a predetermined path defining a plurality of printing positions;

said printing positions being arranged in first and second groups;

means rotatably supporting the printing wheel on the carriage means and supporting the printing wheel for pivotal movement on the carriage means between a first position wherein the first row of typefaces is aligned with the hammer means and a second position wherein the second row of typefaces is aligned with the hammer means;

a cam extending generally along the predetermined path and including a first portion extending parallel to the path and adjacent to the first group of printing positions, a second portion extending parallel to the path and at a different elevation than the first portion and adjacent to the second group of printing positions, and a camming surface interconnecting the first and second portions;

a drive motor mounted on the carriage means and having an output shaft;

a drive pinion mounted on the output shaft of the drive motor for rotation thereby; a print wheel drive gear meshing with the drive pinion;

a drive shaft interconnecting the print wheel drive gear and the print wheel;

a cam follower mounted on the print wheel drive shaft and engaging the cam so that the first row of typefaces on the print wheel is aligned with the hammer means when the cam follower engages the first portion of the cam and so that the second row of typefaces on the print wheel is aligned with the hammer means when the cam follower engages the second portion of the cam;

a reduction gear meshing with the drive pinion;

a pinion mounted on the reduction gear for engagement therewith; and a rack extending along the predetermined path and meshing with the reduction gear pinion to move the carriage means along the predetermined path under the action of the drive motor.

2. The printer according to claim 1 wherein the drive motor functions to continuously rotate the print wheel and to continuously move the carriage means along the predetermined path.

3. The printer according to claim 1 wherein the first and second portions of the cam are disposed on the right-hand and left-hand sides of the predetermined path, respectively, and wherein the first and second rows of typefaces on the print wheel comprise symbols and numerical digits, respectively.

4. The printer according to claim 1 further including means for positioning a length of paper to receive printing, and means responsive to movement of the carriage means across the complete length of the predetermined path to advance the paper by one line space.

* * * * *